US006413015B1

(12) United States Patent
Poirier et al.

(10) Patent No.: US 6,413,015 B1
(45) Date of Patent: Jul. 2, 2002

(54) BEAVER CONTROLLING CULVERT ATTACHMENT

(76) Inventors: Keith Poirier; Karen Poirier, both of Box 19, Site 502, RR 5, Stony Plain (CA), T7Z 1X5

( * ) Notice: Subject to any disclaimer, the term of this patent is extended or adjusted under 35 U.S.C. 154(b) by 0 days.

(21) Appl. No.: 09/755,247

(22) Filed: Jan. 8, 2001

(51) Int. Cl.[7] ..... E02B 3/02; E03F 7/06

(52) U.S. Cl. ..... 405/125; 210/170; 405/40; 405/127

(58) Field of Search ..... 405/39, 40, 80, 405/81, 83, 124–127; 210/456, 460, 170

(56) References Cited

U.S. PATENT DOCUMENTS

| | | | | | |
|---|---|---|---|---|---|
| 1,555,841 | A | * | 10/1925 | Harris | 405/125 |
| 2,278,033 | A | * | 3/1942 | Arnold et al. | 405/124 |
| 2,361,231 | A | * | 10/1944 | Nebolsine | 210/170 |
| 4,662,782 | A | | 5/1987 | Lambert | 405/108 |
| 4,797,028 | A | | 1/1989 | Jamieson | 405/108 |
| 4,998,847 | A | | 3/1991 | Thurber | 405/127 |
| 5,037,542 | A | * | 8/1991 | Carroll | 210/161 |
| 6,089,790 | A | * | 7/2000 | Berry, III et al. | 405/127 |
| 6,095,719 | A | * | 8/2000 | Miya et al. | 405/127 |

FOREIGN PATENT DOCUMENTS

| | | | |
|---|---|---|---|
| WO | WO-99/27204 | * | 6/1999 |

* cited by examiner

*Primary Examiner*—Robert E. Pezzuto
*Assistant Examiner*—Tara L. Mayo
(74) *Attorney, Agent, or Firm*—David S. Thompson

(57) ABSTRACT

A beaver controlling culvert attachment prevents beavers from disturbing the flow of water through a culvert. An upstream unit includes a vertical pipe having an upper grate, which prevents the entrance of beavers and debris, while allowing the entrance of water during periods of high water levels. A horizontal pipe has an upstream end attached to an upper portion of the vertical pipe and a downstream end attached to an upstream end of the culvert by an attachment plate. A basket insert is carried within the vertical pipe, and is movable between an in-use position, wherein a grate prevents entrance to the bottom of the vertical pipe, and a clean-out position wherein the grill is elevated to allow disposal of accumulated debris through the horizontal pipe and culvert. A downstream grate prevents beavers from entering the downstream end of the culvert, and from filling the culvert with debris.

3 Claims, 5 Drawing Sheets

FIG. 7
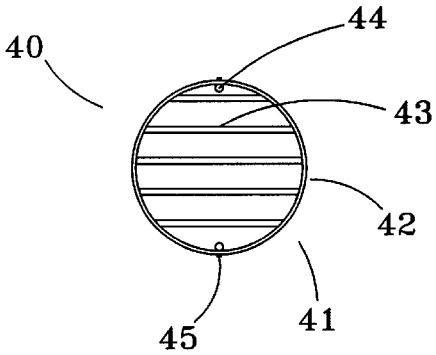
FIG. 6
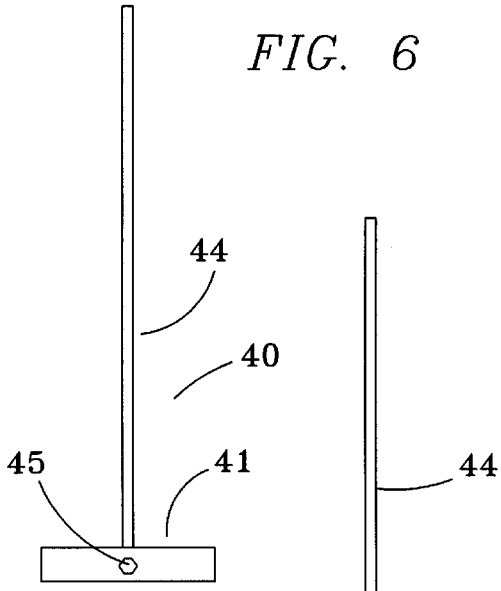
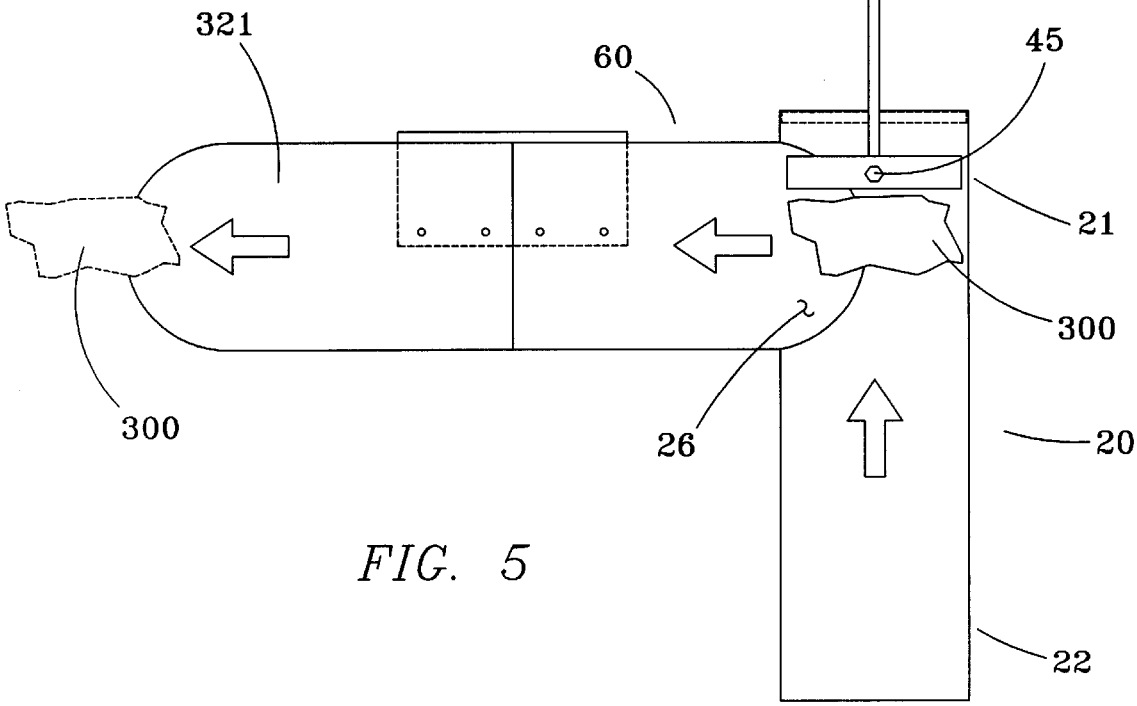
FIG. 5

BEAVER CONTROLLING CULVERT ATTACHMENT

CROSS-REFERENCES

There are no applications related to this application filed in this or any foreign country.

BACKGROUND

Various methods have been used in an attempt to prevent beavers from blocking the inlet or outlet to a water-carrying culvert. Such culverts are used in a number of applications, but are typically installed in a location extending under a roadway between water-carrying upstream and downstream ditches. In general, beavers easily block such a culvert, since the water is directed through the relatively small culvert. Little work is required on the part of the beaver to block such a passage.

Placing a grate over the openings of the culvert is a well known. This prevents the beaver from gaining entrance to the culvert. If the beaver is allowed to gain entrance to the culvert, the entire culvert may soon become plugged with debris. Unfortunately, the grate may actually help the beaver to block the culvert, since debris must only span between adjacent bars of the grate to be supported. As the water level rises, due to the blockage of the lower portion of the grill, the beaver may work on the upper portion. At some point, the reduced water flow is then unable to wash clear the small debris, which falls between the bars and into the culvert. Soon, the beaver has built a plug that effectively blocks the entire culvert.

What is needed is a beaver controlling culvert attachment that is easily adapted for use with any existing or new culvert construction, which is inexpensive to build, install and maintain, and which provides sufficient obstacles to beavers that they are unable to block the culvert and uninspired to try.

SUMMARY

The present invention is directed to an apparatus that satisfies the above needs. A novel beaver controlling culvert attachment is disclosed that is easily adapted for use with any existing culvert or new culvert construction, which is inexpensive to build, install and maintain, and which provides sufficient obstacles to beavers that they are unable to block the culvert and uninspired to try.

The beaver controlling culvert attachment, or a kit of parts for assembling such an attachment, provides some or all of the following structures.

(A) A vertical pipe 20 is perpendicular to the culvert 320. In a preferred application, the diameter of the vertical pipe is the same as the diameter of the culvert. An upper end of the vertical pipe is typically at an elevation slightly higher than the top of the horizontally oriented culvert.

(B) A horizontal pipe 60 is attached to the vertical pipe in a manner that allows communication between them, particularly allowing the flow of water and debris, typically upwardly through the vertical pipe, through the horizontal pipe, and downstream through the culvert.

(C) An upper grate 30 is carried by an upper opening defined in the vertical pipe. The upper grate prevents the entrance of debris to large to be washed clear of the culvert, and prevents the entrance of beavers, while allowing water to enter the vertical pipe when the water level is unusually high.

(D) A basket insert 40 is carried within the vertical pipe, and is movable between upper and lower positions. In a typical application, the basket insert is oriented in the lowered or in-use position, wherein the grill 41 of the basket insert prevents the entrance of debris or beavers through the lower opening of the vertical pipe. When the lower side of the grill of the basket insert becomes fully or partially debris covered, the basket insert may be raised to a clean-out position, which allows the debris travels down the culvert.

(E) An attachment plate 50 fastens the downstream end of the horizontal pipe to the upstream end of the culvert.

(F) A downstream grate 70 attaches to the downstream end of the culvert, and prevents the entrance of a beaver that might attempt to fill the culvert with a quantity of debris sufficient to block the flow of water.

It is therefore a primary advantage of the present invention to provide a novel beaver controlling culvert attachment that prevents beavers from entering a culvert, and that substantially prevents beavers from depositing debris in a manner which blocks the flow of water through the culvert.

Another advantage of the present invention is to provide a novel beaver controlling culvert attachment that is adapted for use with both new and existing culverts.

A still further advantage of the present invention is to provide a novel beaver controlling culvert attachment that provides a basket insert that is movable between an in-use position, which blocks the entrance of beavers, and a clean-out position, which allows debris accumulated on the basket grill portion of the basket insert to be flushed down the culvert.

Other objectives, advantages and novel features of the invention will become apparent to. those skilled in the art upon examination of the specification and the accompanying drawings.

DRAWINGS

These and other features, aspects, and advantages of the present invention will become better understood with regard to the following description, appended claims, and accompanying drawings where:

FIG. 5 is a cross-sectional view of the upstream unit of FIG. 4, particularly showing the basket insert in the clean-out position, whereby debris is being flushed down the horizontal pipe into and through the culvert.

FIG. 6 is a side view of the basket insert.

FIG. 7 is a top view of the basket insert.

DESCRIPTION

Figure 1:
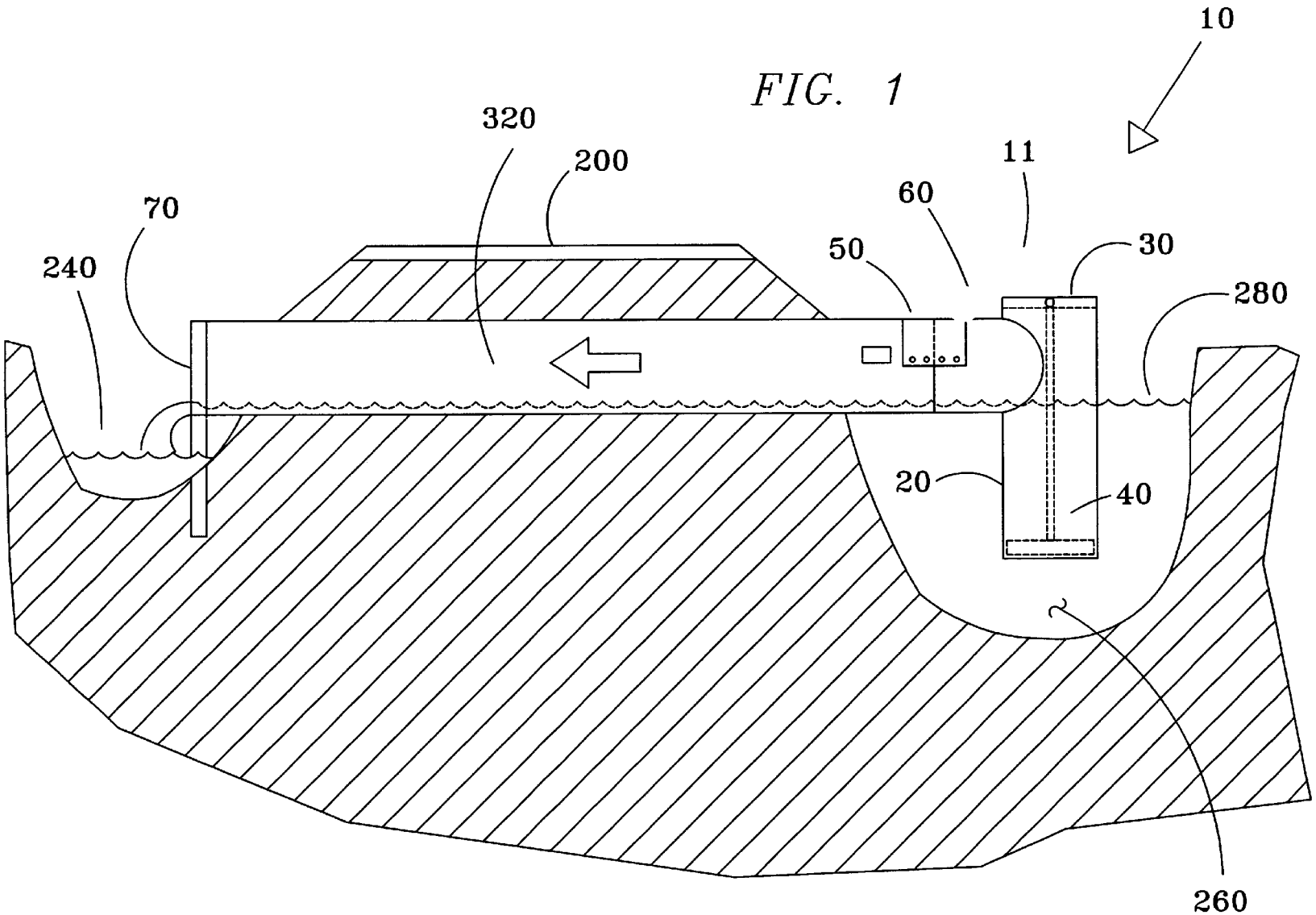
FIG. 1 is a side cross-sectional view of a version of the beaver controlling culvert attachment of the invention.
Figure 2:
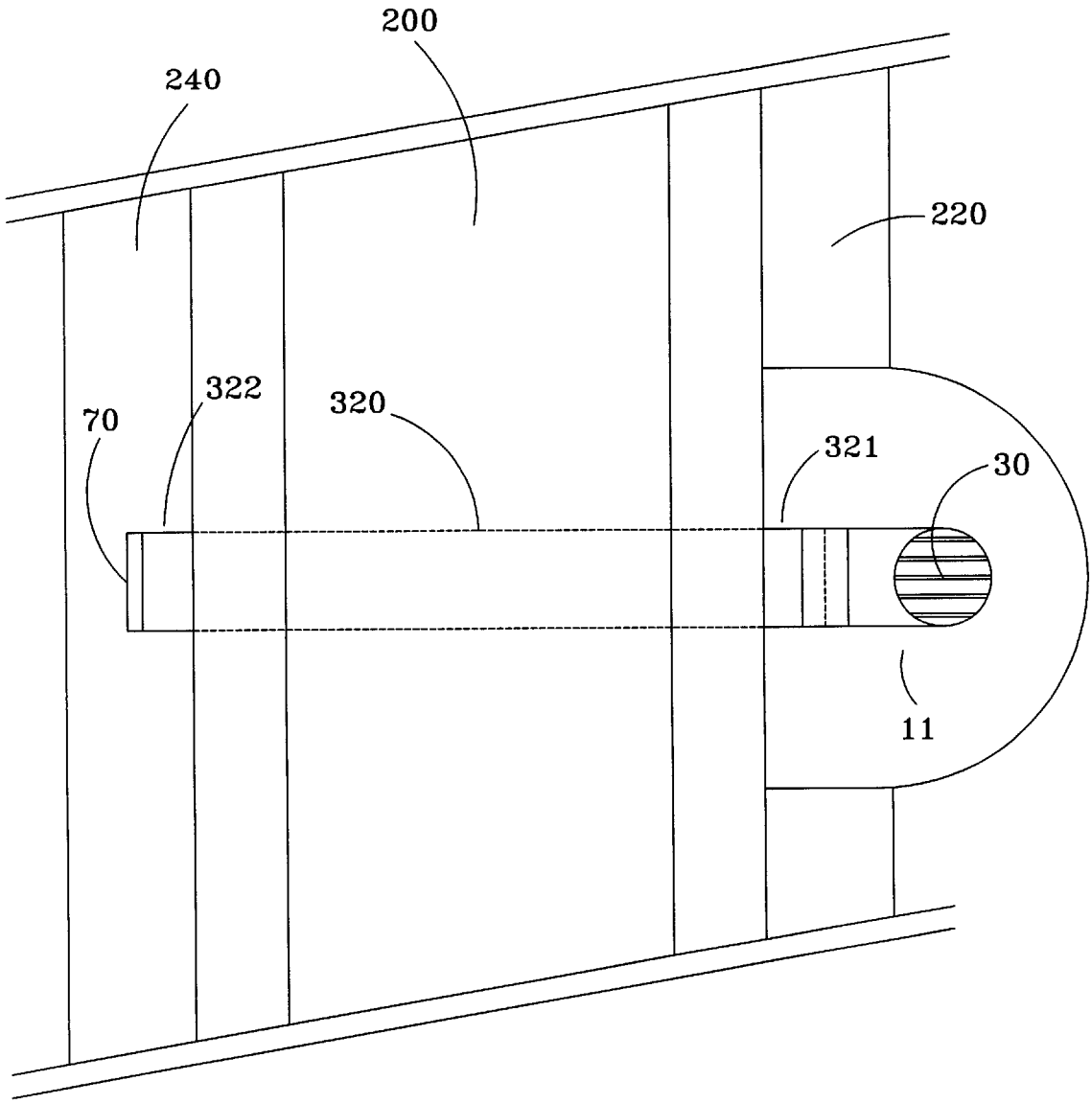
FIG. 2 is a top view of the beaver controlling attachment of FIG. 1.

Referring in generally to FIGS. 1 through 5, a beaver controlling culvert attachment 10 constructed in accordance with the principles of the invention is seen. The attachment prevents beavers from disturbing the flow of water through a culvert of the type typically used to allow water 280 passage from an upstream ditch 220 to a downstream ditch 240 under a road 200. A preferred embodiment of the beaver controlling culvert attachment includes a kit of parts comprising an upstream unit 11 and a downstream grate 70. The upstream unit includes a vertical pipe 20 having an upper grate 30, which prevents the entrance of beavers and debris 300, while allowing the entrance of water during periods of high water levels. A horizontal pipe 60 has an upstream end attached to an upper portion of the sidewall of the vertical pipe and a downstream end attached to an upstream end of the culvert by means of an attachment plate 50. A basket insert 40 is carried within the vertical pipe, and is movable between an in-use position, wherein a grate prevents entrance to the bottom of the vertical pipe, and a clean-out position wherein the grill is elevated to allow disposal of accumulated debris through the horizontal pipe and culvert. The downstream grate 70 prevents beavers from entering the downstream end of the culvert, and from filling the culvert with water-blocking debris.

After installation, a vertical pipe 20 having upper and lower openings 23, 24 defined in upper and lower ends 21, 22 is perpendicular to the culvert 320. In a preferred application, the diameter of the vertical pipe is the same as the diameter of the culvert. Also in the preferred application, the vertical pipe is made of corrugated metal, typically covered with zinc plating or similar treatment, to resist corrosion.

Figure 3:
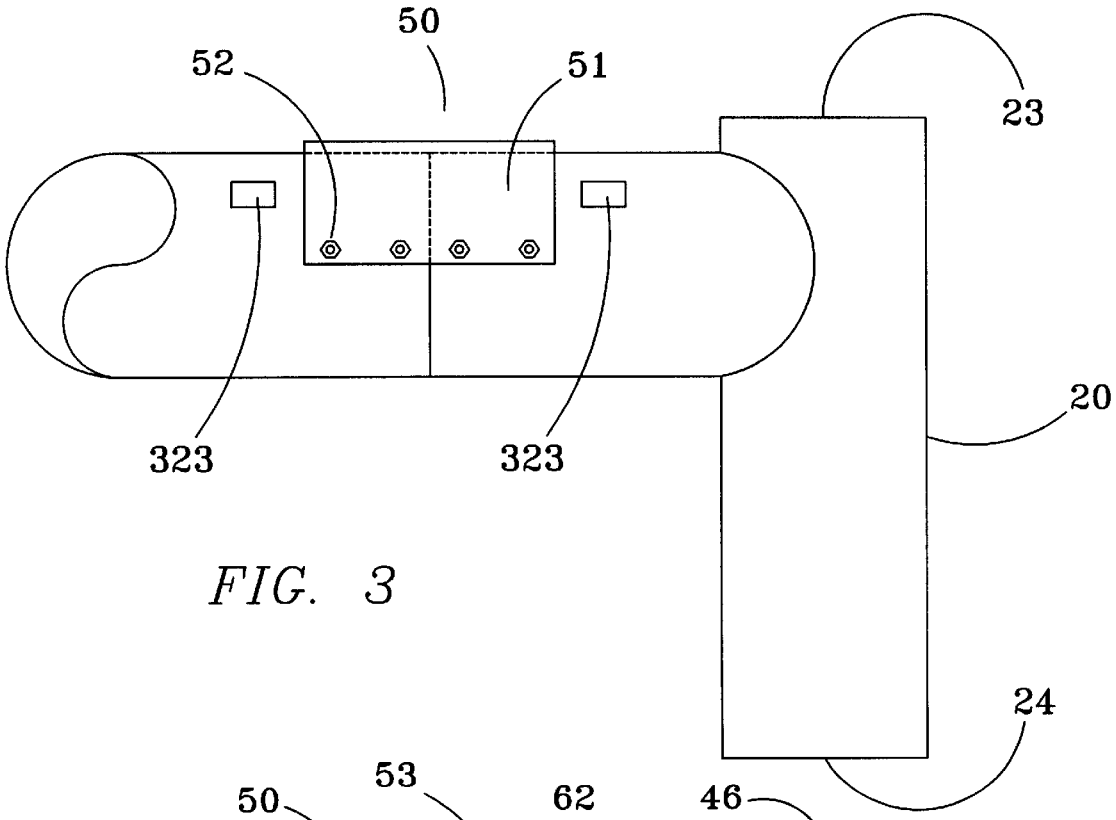
FIG. 3 is a side view of the upstream unit.
Figure 4:
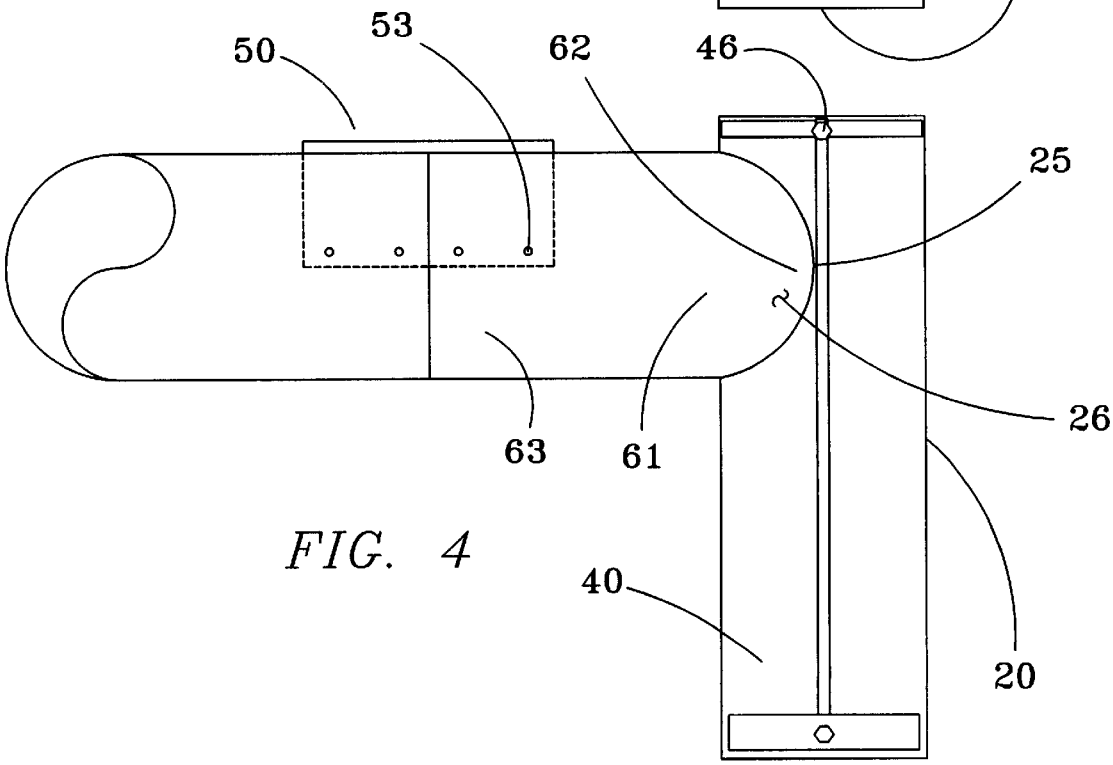
FIG. 4 is a cross-sectional side view of the upstream unit of FIG. 3, particularly showing the basket insert in the in-use position.

Referring to FIGS. 1, 3 and 4, it can be seen that the rim of the upper end 21 of the vertical pipe is typically at an elevation slightly higher than the top of the horizontally oriented culvert. A lower end 22 of the vertical pipe is located in a bell hole 260.

The bell hole is typically dug in a half-circle, with a radius of approximately 9 meters. A tracked hoe with a 10.5-meter reach is preferred. The dirt removed from the bell hole is typically redistributed on the downstream side of the culvert, along the downstream ditch 240.

A round opening 25 is defined in an upper portion of the sidewall of the vertical pipe. The round opening allows connection to the horizontal pipe, and water flow through a passage 26 between the two. The round opening is sized to connect to a saddle cut 62 on the upstream end 61 of the horizontal pipe.

An upper grate 30 is carried by an upper opening 23 of the vertical pipe. The upper grate prevents the entrance of debris 300 and beavers, while allowing water to enter the vertical pipe when the water level is unusually high. As seen in FIG. 1, the upper grate and upper opening 23 are at an elevation lower than the road 200. As a result, before the water level rises high enough to cover the road, water may pass downwardly through the upper grate 30 into the vertical pipe 20.

A horizontal pipe 60 is attached to the vertical pipe in a manner that allows the flow of water and debris, typically upwardly through the vertical pipe, through the horizontal pipe, and downstream through the culvert.

Referring to FIGS. 3 and 4, the horizontal-pipe 60 has an upstream portion 61 having a saddle cut end 62 sized to mate with the round opening 25 defined in the sidewall of the vertical pipe 20.

A downstream end 63 or the horizontal pipe is attached to the upstream end 321 of the culvert 320 by an attachment plate 50 or similar fastening device.

As seen in FIGS. 1, 4 and 5, a basket insert 40 is carried within the vertical pipe. The basket insert prevents beavers from entering the culvert in the lowered in-use position, and also allows the convenient removal of debris 300 in the raised clean-out position. As seen in FIG. 5, the basket insert is manually movable between a lower in-use position and an upper clean-out position.

Referring particularly to FIGS. 5–7, a preferred basket insert includes a grill 41 carried by two support arms 44. The grill 41 is formed from a rim 42, which is typically made from a short segment of culvert type pipe having an outside diameter incrementally less than the inside diameter of the vertical pipe. One or more bars 43 are connected at both ends to the rim. The space between bars and between bars and the rim should be less than the size of a small beaver and less than the size of debris which is too large to be carried completely through the culvert by minimal water flow, and which is therefore likely to accumulate within the culvert.

As seen in FIGS. 4–7, two support arms 44 are carried by diametrically opposed sides of the rim 42 of the grill 41. A lower end of each support arm is attached to the rim by a lower fastener 45, which may be a bolt, screw, welded connection or other fastening means. As seen in FIGS. 1 and 4, an upper end of each support arm is connected to an upper portion of the sidewall of the vertical pipe.

As seen in FIG. 4, the basket insert is oriented in the lowered in-use position, wherein the grill 41 of the basket insert prevents the entrance of debris or beavers through the lower opening 24 of the vertical pipe. The in-use position seen in FIG. 4 is the default position, which does not require an operator's attention.

As seen in FIG. 5, the lower side (or both sides) of the grill may become fully or partially covered or enclosed by debris 300. This could result from the movement of water carrying debris, which is deposited against the grill 41 over time. Such debris then becomes stuck, and remains in place. In this circumstance, the debris held against the grill may tend to block water flow.

To clean the grill, an attendant may move the basket insert to a clean-out position, seen in FIG. 5. This is accomplished by releasing the upper fasteners 46, so that the support arms may be used to manually pull the grill upward, until the grill 41 is carried within the vertical pipe adjacent to, or immediately above, the passage 26 to the horizontal pipe.

As seen in FIGS. 1 and 3–5, an attachment plate 50 fastens the downstream end 63 of the horizontal pipe 60 to the upstream end 321 of the culvert 320. A preferred attachment plate includes a half-cylinder pipe. body 51 defining a plurality of fastener holes 53. In most applications, the culvert, horizontal pipe, vertical pipe and fastener plate are all made of corrugated metal having a corrosion resistant coating, such as zinc. Where the attachment plate is made in a corrugated configuration, frictional forces between the attachment plate, horizontal pipe and culvert are increased, and the resulting connection is strong.

As seen in FIGS. 3 and. 4, the attachment plate is mounted on the top half of the downstream end of the horizontal pipe and the top half of the upstream end of the culvert. Fastener holes defined through .the culvert and horizontal pipe correspond to the fastener holes defined in the attachment plate. Typically, eight or more total fasteners 52 are used to secure the culvert, fastener plate and horizontal pipe. As seen in FIG. 3, a hole 323 may be defined in an upper portion of the culvert 320 or in the horizontal pipe 60 to allow access to both sides of the fasteners 52.

Figure 8:
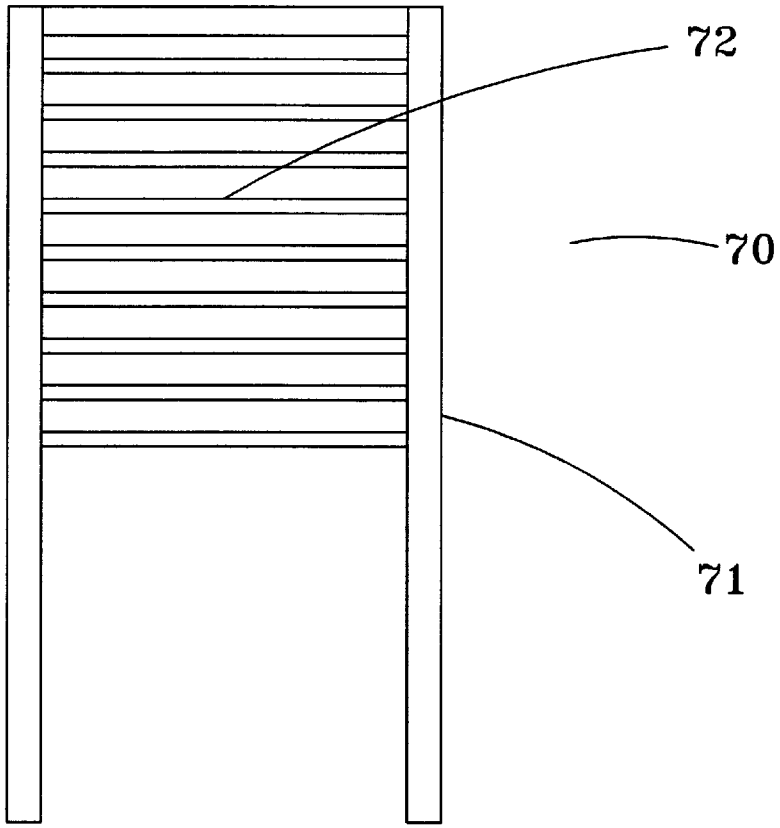
FIG. 8 is a front orthographic view of the downstream grate.

A preferred kit of parts for assembling a beaver controlling culvert attachment includes a downstream grate 70. As seen in FIGS. 1 and 8, a downstream grate 70 attaches to the downstream end 322 of the culvert 320. Installed in this position, the downstream grate prevents the entrance of a beaver that might attempt to fill the culvert with a quantity of debris sufficient to block the flow of water.

As seen particularly in FIG. 8, a preferred downstream grate 70 includes a pair of vertical pipes 71 separated by a distance greater than, or equal to, the diameter of the culvert. The length of each vertical pipe 71 is typically sufficiently greater than the diameter of the culverts to allow the lower ends of the vertical pipes to be planted in the ground, as seen in FIG. 1.

A plurality of horizontal bars 72 form a grill having a size equal to, or greater than, the area of the opening of the culvert. The distance between bars should prevent beavers from entering, but allow any debris getting into the culvert through the upstream unit 11 to pass.

The previously described versions of the present invention have many advantages, including a primary advantage of providing a novel beaver controlling culvert attachment that prevents beavers from entering a culvert, and that substantially prevents beavers from depositing debris in a manner which blocks the flow of water through the culvert.

Another advantage of the present invention is to provide a novel beaver controlling culvert attachment that is adapted for use with both new and existing culverts.

A still further advantage of the present invention is to provide a novel beaver controlling culvert attachment that provides a basket insert that is movable between an in-use position, which blocks the entrance of beavers, and a clean-out position, which allows debris accumulated on the basket grill portion of the basket insert to be flushed down the culvert.

Although the present invention has been described in considerable detail and with reference to certain preferred versions, other versions are possible. For example, while in a preferred embodiment of the invention an attachment plate connects the horizontal pipe to the culvert, other attachment means could be substituted, while still in keeping with the teachings of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A beaver controlling culvert attachment, comprising:

(A) a vertical pipe, defining an upper opening and a lower opening;

(B) a horizontal pipe, in communication through a passage resulting from a hole defined in a sidewall of the vertical pipe with the vertical pipe, defining an upstream opening and a downstream opening;

(C) an upper grill, carried by the upper opening of the vertical pipe;

(D) an attachment plate, connected to a downstream end of the horizontal pipe;

(E) a basket grill, carried within the vertical pipe and movable between a first position and a second position within the vertical pipe, the basket grill comprising;

(a) a grill, comprising:

(i) a rim having an outside diameter incrementally smaller than an inside diameter of the vertical pipe; and (ii) at least one bar having first and second ends attached to the rim;

(b) at least one support arm, having a lower end attached to the rim and an upper end attached to the vertical pipe; and (F) wherein the basket grill is movable between an in-use position wherein the grill is carried within the lower opening defined in the vertical pipe and a clean-out position wherein the grill is carried within the vertical pipe immediately above the passage.

2. The beaver controlling culvert attachment of claim 1, wherein the upstream opening of the horizontal pipe is saddle cut.

3. A kit of parts for protecting a culvert from blockage, comprising:

(A) a vertical pipe, defining an upper opening and a lower opening;

(B) a horizontal pipe, in communication through a passage resulting from a hole defined in a sidewall of the vertical pipe with the vertical pipe, defining an upstream opening and a downstream opening;

(C) an upper grill, carried by the upper opening of the vertical pipe;

(D) an attachment plate, connected to a downstream end of the horizontal pipe;

(E) a basket grill, carried within the vertical pipe and movable between a first position and a second position within the vertical pipe, the basket grill comprising;

(a) a grill, comprising:

(i) a rim having an outside diameter incrementally smaller than an inside diameter of the vertical pipe; and (ii) at least one bar having first and second ends attached to the rim;

(b) at least one support arm, having a lower end attached to the rim and an upper end attached to the vertical pipe;

(F) wherein the basket grill is movable between an in-use position wherein the grill is carried within the lower opening defined in the vertical pipe and a clean-out position wherein the grill is carried within the vertical pipe immediately above the passage; and (G) a downstream grill.

* * * * *